US006331750B1

(12) United States Patent
Thompson

(10) Patent No.: US 6,331,750 B1
(45) Date of Patent: Dec. 18, 2001

(54) LAMP HAVING MULTI-COLORED RADIANT OUTPUT

(76) Inventor: Gary Thompson, 20922 Franwood Dr., Saugus, CA (US) 91350

( * ) Notice: Subject to any disclaimer, the term of this patent is extended or adjusted under 35 U.S.C. 154(b) by 0 days.

(21) Appl. No.: 09/397,310

(22) Filed: Sep. 16, 1999

Related U.S. Application Data

(60) Provisional application No. 60/100,798, filed on Sep. 18, 1998.

(51) Int. Cl.[7] ..... H01J 5/16
(52) U.S. Cl. ..... 313/113; 110/112
(58) Field of Search ..... 313/479, 489, 313/110, 112, 113

*Primary Examiner*—Vip Patel

(74) *Attorney, Agent, or Firm*—Roger A. Marrs

(57) ABSTRACT

A light source device is provided for separating light into several light components with a plurality of colors or hues which includes a source of white light and at least one dichroic filter carried on an envelope of the light source device. The filter selects a particular wavelength band from a visible light spectrum and transmits only light from the selected wavelength band therethrough. The filter includes a mirror for reflecting light having a wavelength band other than the selected wavelength band whereby all transmitted light exits the device in different combinations of colors or hues. Several filters and mirrors may be arranged adjacent to each other with respect to the light source and the apparatus therefore transmits ideally 100% of the light from the light source and no additional means are required for dissipating or absorbing the non-selected wavelength bands since all bands or rays are included in the multi-colored emission.

6 Claims, 3 Drawing Sheets

FIG. 1
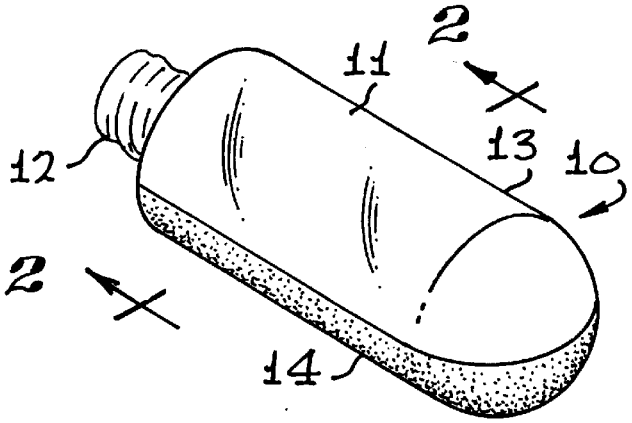
FIG. 2
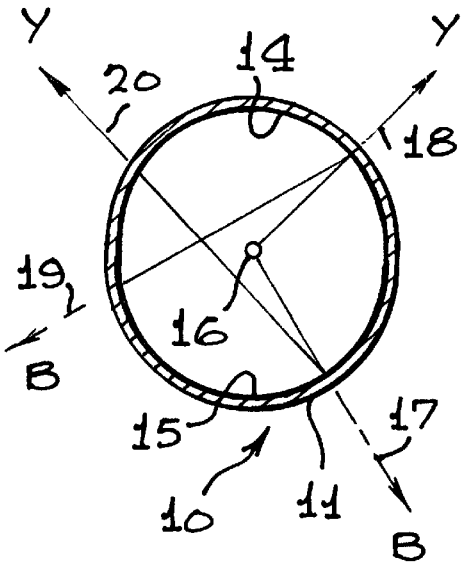
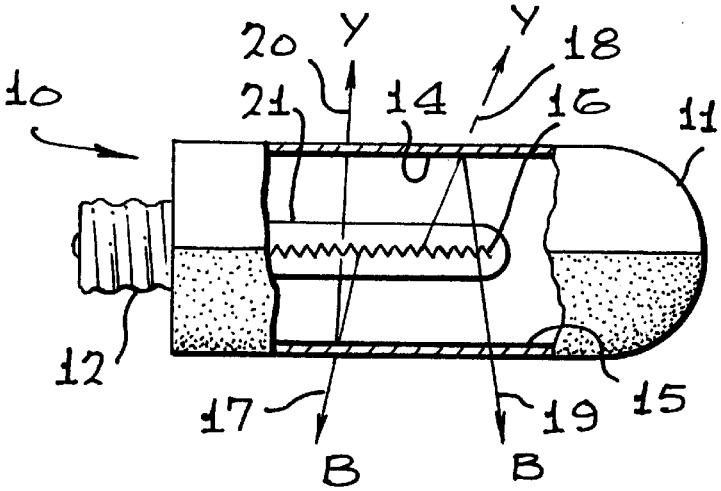
FIG. 3
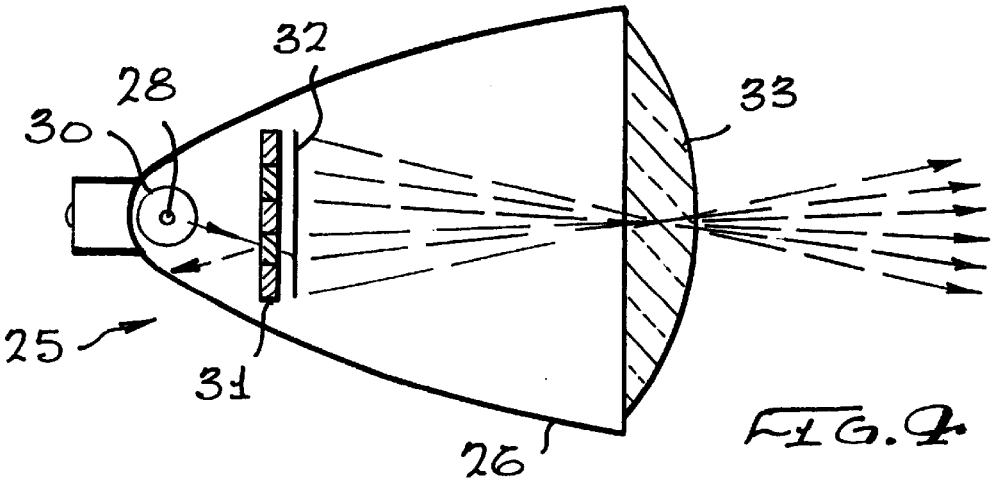
FIG. 4

FIG. 5
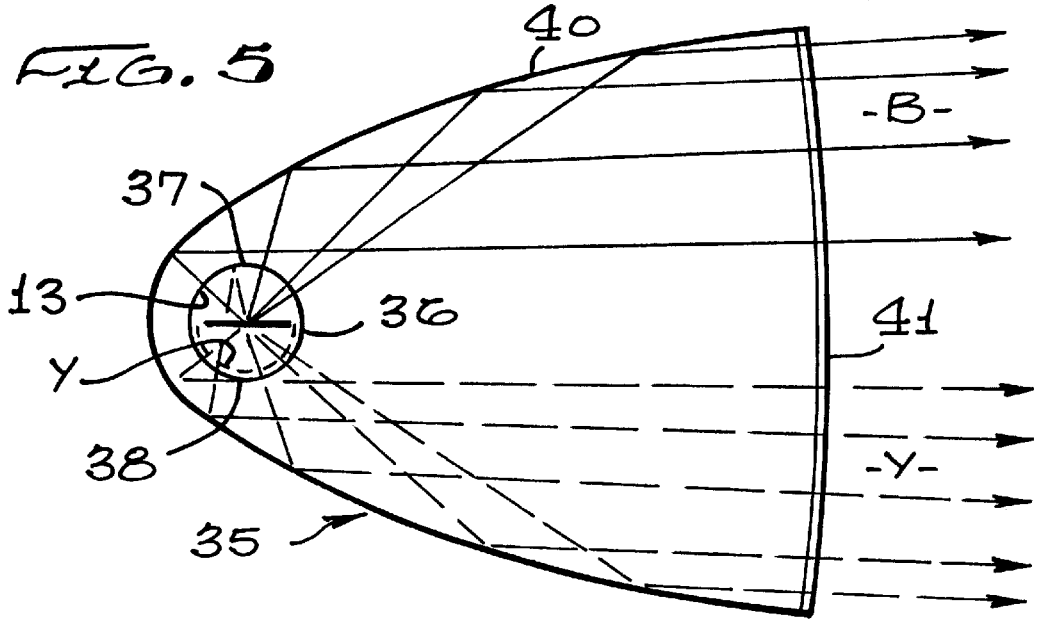
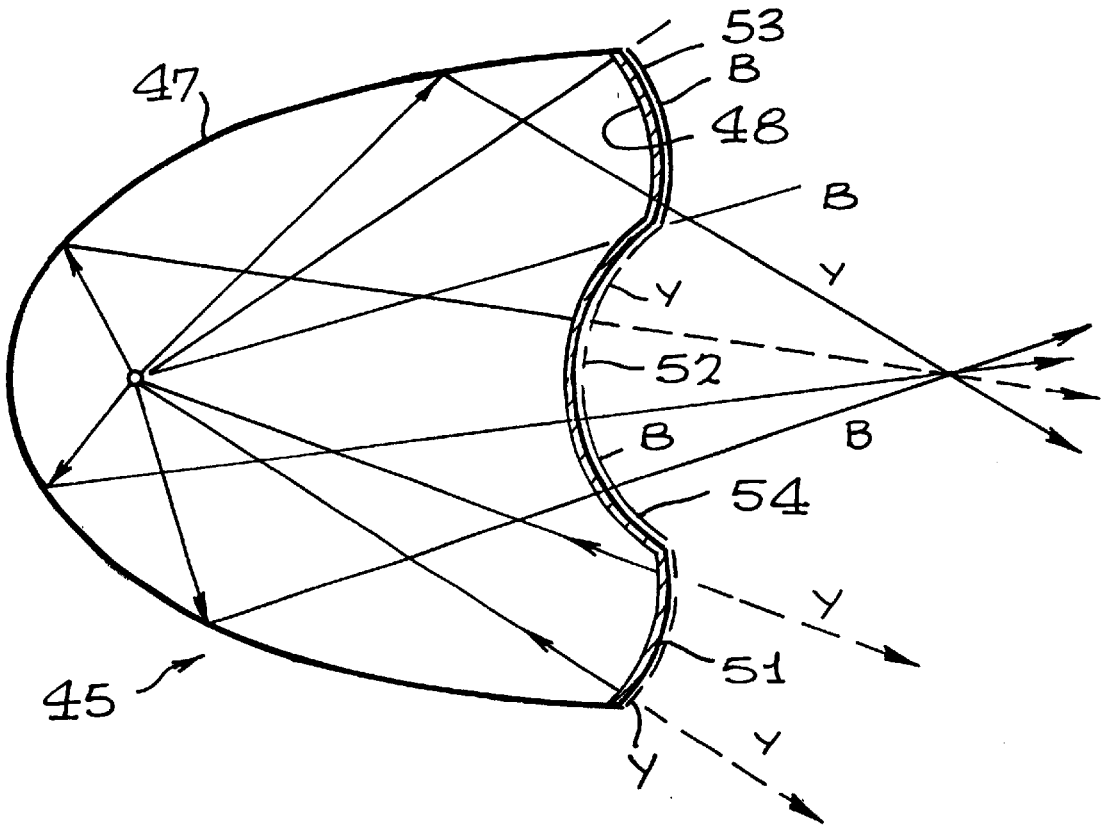
FIG. 6

FIG. 7
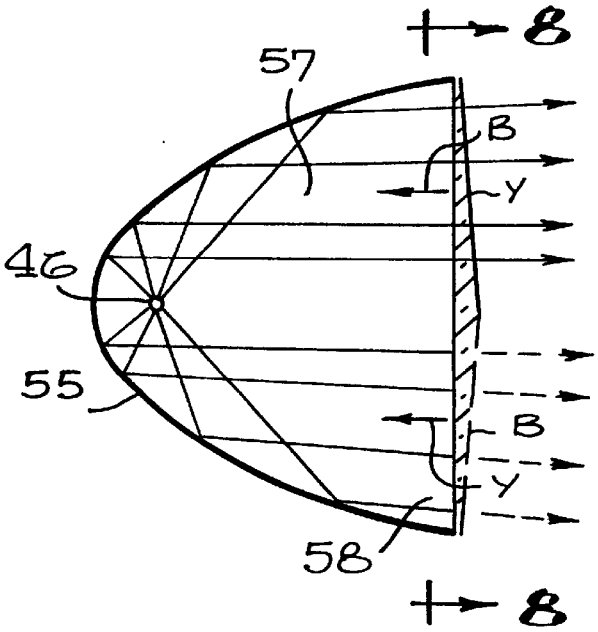
FIG. 9
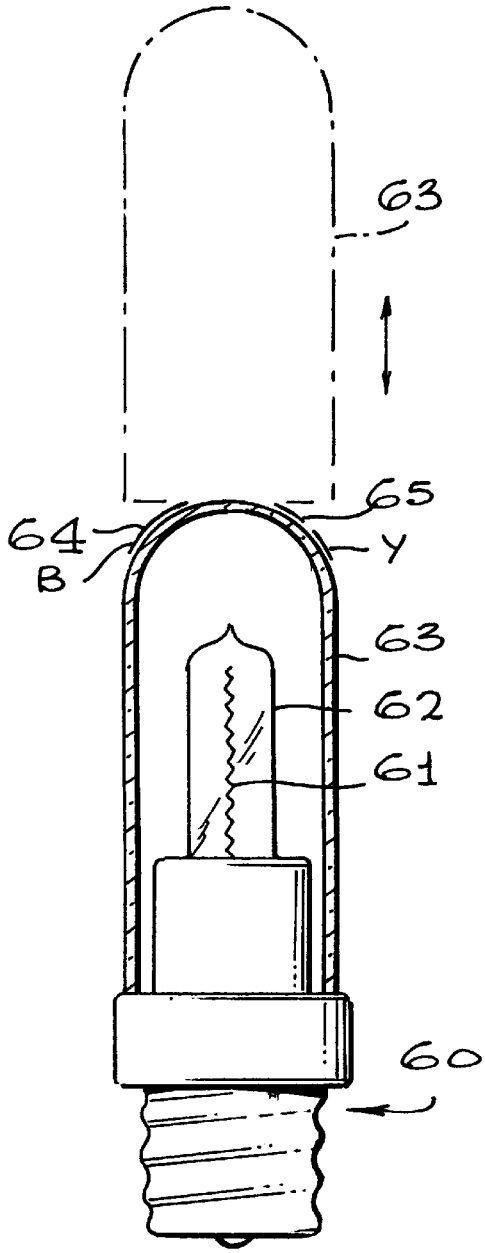
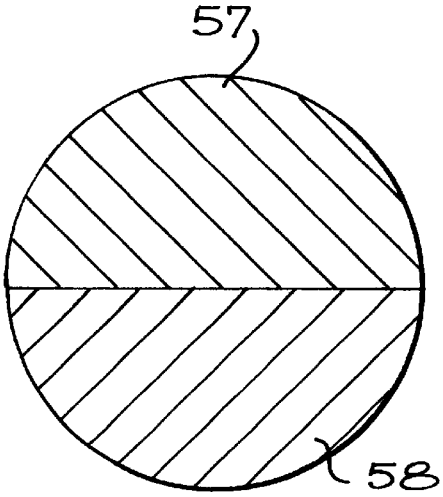
FIG. 8

LAMP HAVING MULTI-COLORED RADIANT OUTPUT

Priority claimed based on Ser. No. 60-100,798 filed Sep. 18, 1998

BACKGROUND OF THE INVENTION

1. Field of the Invention

The present invention relates to the field of light source apparatus for separating white light into light components of a plurality of colors, and more particularly to a novel lamp device having multi-colored radiant output with high efficiency for use in decorating or display applications.

2. Brief Description of the Prior Art

In the past, conventional colored floodlights, colored spotlights or colored lights have been employed for use in architectural, landscaping and various display lighting. In such prior uses, conventional colored floodlights or the like emitted a single hue and were used in multiple lamps in order to produce alternate color lighting effects. Since the light source within a single lamp emits multiple hues, pairs of filters or mirrors are sometimes employed so as to permit only a selected hue to be emitted. The unselected or undesired hue is then dissipated or absorbed within the lamp. Some lamps use light-absorbing filters to remove the unwanted wavelengths and to dissipate the energy as heat. Others use dichroic filters in the form of thin film to reflect the undesired wavelengths to a surface within the lamp where the undesired wavelengths are dissipated as heat. Efficiency of such prior lamp construction is very low, especially when saturated hues, such as red, green or blue are transmitted.

Such a conventional light source is disclosed in U.S. Pat. No. 5,096,280 which describes a light source apparatus for separating a white light into light components of a plurality of colors. However, only a single color is eventually emitted with undesired or unselected colors or hues being blocked by dichroic filters. Therefore, such a prior light source apparatus is inefficient and usage is very limited. The lamp disclosed in U.S. Pat. No. 4,839,553 pertains to a light source that divides color rays out and unwanted or non-selected rays are absorbed into a housing and are not used.

Therefore, a long-standing need has existed to provide a multi-colored light source for decoration or display applications that is more efficient than that described by the prior art and which includes a single multi-colored lamp source which not only emits a plurality of colors or hues but selectively emits the colors or hues in appropriate directions by employing dichroic coatings or filters and reflectors to direct and redirect colored rays to desired display locations.

SUMMARY OF THE INVENTION

Accordingly, the above problems and difficulties are avoided by the present invention which provides a novel light source device for separating a light into several light components or rays composed of a plurality of colors or hues and which includes a single source of high efficiency light and at least one dichroic filter carried on an envelope of the light source device. The filter selects a particular wavelength band from the viable high efficiency light and transmits only light from the selected wavelength band therethrough. The filter, including a reflector or mirror, reflects or redirects the wavelength band other than the selected wavelength band so that all rays of the transmitted wavelength band exit the lamp. Several filters and/or mirrors may be arranged adjacent to each other and with respect to the light source and the apparatus therefore transmits ideally 100% of the light from the single light source and no additional means are required for dissipating or absorbing the undesired wavelength bands or rays.

Therefore, it is among the primary objects of the present invention to provide a lamp that employs a single light source and at least one dichroic filter and reflector arrangement to separate selected wavelengths or color groups of the visible spectrum and that distributes the selection in a desired direction to produce multi-colored emission.

Another object of the present invention is to provide a multi-colored lamp device wherein the emitted light can range from high color saturation to low color saturation and wherein many lamp arrangements are employed for floodlight purposes, spotlights or other omnidirectional emission lamps.

Still a further object of the present invention is to provide a lamp device having multi-colored radiant output wherein the visible wavelengths that are emitted from a single light source are transmitted through the lamp envelope through dichroic filters and reflectors to produce a desired effect and provide high efficiency without utilizing light ray dissipating or absorption means.

Another object resides in allowing higher wattages to be placed in smaller lamp envelopes than conventional colored lighting systems can be housed.

Further, an object resides in the ability of the inventive concept to separate colors by wavelengths and to redirect selective wavelengths so that efficiency is increased by utilizing most of the visible spectrum from a single source.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view of a lamp device having multi-colored radiant output from a single light source in accordance with the present invention without heat dissipating or heat absorption means;

FIG. 2 is a transverse cross-sectional view of the lamp device shown in FIG. 1;

FIG. 3 is a side elevational view, partially broken away, to illustrate the interior of the lamp device shown in FIGS. 1 and 2;

FIG. 4 is a diagrammatic view of an alternate lamp device having multi-colored radiant output in accordance with the present invention;

FIG. 5 is a diagrammatic view of a lamp device incorporating another version of the present invention;

FIG. 6 is still another version of the lamp device incorporating the present invention;

FIGS. 7 and 8 illustrate an alternate version of lamp device having multi-colored radiant output; and FIG. 9 is a lamp device incorporating a protective cover incorporating different dichroic filters.

DESCRIPTION OF THE PREFERRED EMBODIMENTS

Referring to FIGS. 1 and 2, a lamp incorporating the present invention is illustrated in the general direction of arrow 10 which includes an envelope 11 which encloses a vacuum area having a single filament 16 as a light source that terminates with an electrical screwtype socket 12. The envelope 11 has a clear portion 13 and a layer or coating of dichroic filter/mirror material 14 which for illustrative purposes can be stated as being a yellow dichroic filter and a reflective mirror combination. In this embodiment, light emitting from the filament 16 is a white light and the yellow component Y of the color spectrum will pass through the yellow dichroic filter 14 while the blue color component B of the spectrum will be reflected back through the clear portion of the envelope or bulb 13. In this example, a yellow light is emitted from half of the lamp and the other half emits a bluish-white light. Only one color of dichroic filter is employed for emitting two colors and none of the colors in the spectrum are blocked so that there is an absence of heat energy accumulation.

In FIG. 2, the bulb 10 has been modified with a second color of dichroic filter such as blue, which is indicated by numeral 15. In this example, the white light emanating from the filament 16 is radiated against the yellow dichroic filter 14 and the blue dichroic filter 15. The blue component or portion B of the white light spectrum will pass through the filter 15, as indicated by numeral 17, while the yellow portion & of the white light emission will pass through the yellow dichroic filter 14 in the direction of arrow 18. The blue portion B of the white light striking the yellow dichroic filter 14 will be mirrored or reflected back along arrow 19 to exit via filter 15. The yellow portion Y of the white light which strikes the blue filer 15 will be redirected or reflected back through the yellow filter 14 in the direction of arrow 20. Thus, in both FIGS. 1 and 2 it can be seen that the efficiency of the lamp 10 is greatly increased by the use of dichroic filters which will pass a portion of the white light with the remainder portion of the white light being reflected back through either a second filter or an unfiltered portion of the lamp envelope. None of the light rays are prevented from exiting the envelope.

Referring to FIG. 3, it can be seen that the single filament. 16 emits a white light which radiates against the entire inside of the envelope 11. However, with the presence of filters strategically or critically located on the envelope, certain colors of the spectrum will be passed directly through the envelope and others reflected for emission through another portion of the envelope. As explained with respect to FIG. 2, white light striking the blue filter 15 will permit the blue component 17 to pass through while the yellow component Y will be reflected back and passed through the yellow filter 14, as indicated by arrow 20. Likewise, the yellow component Y of the white light radiation will strike the yellow filter 14 and pass through, as indicated by arrow 18, while the blue component B will be reflected or mirrored back through the blue filter 15, as indicated by arrow 19. If desired, a transparent globe or envelope may be placed around the filament 16, as is indicated by numeral 21 so as to create an internal light source or lamp per se. Such construction is used in conventional lighting techniques without colored filters and, therefore, it is within the concept of the present invention to use colored dichroic filters on the globe 21 in the same fashion as previously described with respect to embodiments 1 through 3 inclusive.

Referring now in detail to FIG. 4, another version of the lamp device of the present invention is illustrated in the general direction of arrow 25 which includes a reflector envelope 26 that is of a conical configuration terminating at its apex in an electrical screw-type connector 27. A single light source 28 is included which may or may not be surrounded by an envelope 30. Immediately ahead of the filament and the envelope 30, a dichroic filter/mirror 31 is included which has alternate and different color filters across its length. If desired, a diffuser 32 may be employed. The opposite end of the reflector envelope 26 includes a lens or lenses, identified by numeral 33. Therefore, as white light is emitted and radiated from the single filament 28, it can pass through the pattern of dichroic filters 31 and the respective colors of the spectrum will pass through certain portions of the overall filter. These portions are then combined and passed through thelens 33, as shown by the multiple arrows. Each arrow represents a beam of different colored light depending on the arrangement of the dichroic filters in the pattern 31. Arrow 29 is a light ray of a color that cannot pass through a portion of the filter but is redirected or reflected back to the reflection surface of the envelope 26 for redirection back to an acceptable portion of the filter.

It is also to be understood that similar to the embodiment shown in FIG. 3, the envelope 30 may include dichroic filter layers of different colors and that the pattern of the layers depends on the ultimate color radiation desired. It is also to be understood that the filter 31 may be linear or may be circular with a random placement of dichroic filters spaced apart from one another. A typical pattern for a linear arrangement would commence at one end with magenta followed by green, white, yellow and blue.

Referring now to FIG. 5, another version of the lamp is indicated in the general direction of arrow 35 and this embodiment is similar to the embodiment shown in FIG. 4 with the exception that the lens is not required. In this embodiment, white light is radiated through the first envelope 36 which includes a blue dichroic filter 37 on one half of the envelope 36 and a yellow dichroic filter/mirror 38 on the other half of the envelope 36. The filter may be solid, fully occupying the interior of envelope 36 or the filter may be a coating or layer on the inside surface of the envelope 36. In either event, the white light is radiated to the respective filters and the respective blue and yellow components will pass through the filters and be reflected against the inside surface of an envelope or bulb 40 where the beams are reflected into a parallel relationship for emitting through a clear window 41 or opening. Again, the principle is the same as previously described wherein the efficiency of the lamp device is greatly improved since a single lamp can handle and distribute a plurality of colors simultaneously. Little visable energy is lost and there is no need to provide for heat elimination or dissipation of any unused color or radiation.

Referring now in detail to FIG. 6, another version of the invention is illustrated in the direction of arrow 45 wherein a filament 46 emits white light which is then reflected against the surface of the lamp envelope 47 and subsequently redirected to a lens or window 48. It is to be particularly noted that the white light is indicated by numeral 46 as an example and that when reflected, will still be white light until the light reaches a plurality of different colored dichroic filters/mirrors. For example, green filters may be indicated by numerals 51 and 52 while magenta filters are indicated by numerals 53 and 54.

FIGS. 7 and 8 illustrate another version of the invention where the dichroic filters/mirrors are of a solid nature residing within the envelope 55 so that when white light is radiated from filament 46, the rays will immediately pass through solid dichroic material. As an example, FIG. 7 is a transverse cross-section which shows the solid arrangement of dichroic filters wherein one side may be of a yellow filter, as indicated by numeral 57, while number 58 illustrates a blue dichroic filter. White light from the source 46 proceeds through the filters with blue and yellow rays passing through blue and yellow filters respectively and their counterpart of blue and yellow rays which do not pass through the filters are returned to the back inside surface of the envelope 55 for reflection through the appropriate filter. In this fashion, efficiency is increased.

Referring now in detail to FIG. 9, another version of the invention is illustrated wherein a screw-type lamp connector 60 carries a filament 61 within a quartz halogen lamp 62. A protective cover 63 is placed over the quartz halogen generator for protecting the user from the quartz halogen explosion. The present invention includes the placing of a blue dichroic filter/mirror 64 on the protective cover 63 and a yellow dichroic filter/mirror 65 on another side or half of the protective cover. Therefore, the principle of radiation, as previously explained with respect to the yellow and blue components of the light are used.

In view of the foregoing, it can be seen that the present invention provides a multi-colored light or lamp device for decorating or display applications that is more efficient than those employed in the prior art. The inventive lamp concept includes a light source with dichroic filters that separate selected wavelengths or color groups of the visible light spectrum and distribute these in a desired direction or directions to produce multi-colored emission. The emitted light can range from high color saturation to low color saturation. Many lamp arrangements are available from floodlights, spotlights or the like to omnidirectional emission lamps. Most of the visible wavelengths that are emitted from the light source are transmitted through the lamp to produce the desired effect and provide high efficiency.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A light source apparatus that emits a visible light having a plurality of colors comprising:

a light source emitting a visible light;

a transparent envelope having an exterior surface and an interior surface enclosing said light source;

at least one dichroic filter partially carried on said envelope surface wherein said dichroic filter is characterized as a reflector for reflecting a desired band of wavelengths of visible light and to transmit all other wavelengths;

said desired band of wavelengths reflected from said dichroic filter exit via said transparent envelope while transmitting all said other wavelengths through said transparent envelope via said dichroic filter whereby the total amount of visible light is emitted as separate colors.

2. The light source apparatus defined in claim 1 including:

a light reflector disposed on said envelope surface in spaced-apart relationship with respect to said dichroic filter for reflecting visible light of all bands of wavelengths; and said light source separating said reflector and said dichroic filter.

3. The light source apparatus defined in claim 2 wherein:

said dichroic filter is linear having a plurality of portions side-by-side wherein each portion is capable of transmitting and/or reflecting bands of wavelengths therethrough.

4. The light source apparatus defined in claim 1 wherein:

multiple dichroic filters are enclosed by said envelope; and a light reflector carried in said envelope separated from said dichroic filters by said light source.

5. The light source apparatus defined in claim 4 wherein:

each of said multiple dichroic filters passes a different color band of wavelengths; and said multiple dichroic filters being arranged in a side-by-side series so as to receive visible light from said light source and from said light reflector.

6. The light source apparatus defined in claim 4 including:

a second envelope enclosing said light source;

said multiple dichroic filters being carried on said second envelope; and said reflector carried on said surface of said first mentioned envelope.

* * * * *